US007859504B2

(12) United States Patent
Furihata et al.

(10) Patent No.: US 7,859,504 B2
(45) Date of Patent: Dec. 28, 2010

(54) LIQUID CRYSTAL DRIVING DEVICE, LIQUID CRYSTAL DISPLAY DEVICE, AND LIQUID CRYSTAL DRIVING METHOD

(75) Inventors: Hirobumi Furihata, Kanagawa (JP); Takashi Nose, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 1059 days.

(21) Appl. No.: 11/292,081

(22) Filed: Dec. 2, 2005

(65) Prior Publication Data

US 2006/0152462 A1 Jul. 13, 2006

(30) Foreign Application Priority Data

Jan. 13, 2005 (JP) ..... 2005-006289

(51) Int. Cl.
*G09G 3/36* (2006.01)

(52) U.S. Cl. ..... 345/98

(58) Field of Classification Search ..... 345/98
See application file for complete search history.

(56) References Cited

U.S. PATENT DOCUMENTS 5,402,142 A * 3/1995 Okada et al. ..... 345/95
6,801,178 B2 * 10/2004 Nitta et al. ..... 345/89
7,432,903 B2 * 10/2008 Kato ..... 345/98

FOREIGN PATENT DOCUMENTS

JP 11337909 A * 12/1999
JP 2000-267618 9/2000
JP 2003-114659 4/2003

* cited by examiner

*Primary Examiner*—Alexander Eisen
*Assistant Examiner*—Robin Mishler
(74) *Attorney, Agent, or Firm*—Young & Thompson

(57) ABSTRACT

A liquid crystal display device according to an embodiment of the present invention includes an active matrix type liquid crystal display panel, in which a set value of a common voltage applied to a common electrode of the liquid crystal display panel is determined based on input image data, and a timing of changing the common voltage to the preset value in accordance with a timing of driving at least one of a scan line and a signal line of the liquid crystal display panel.

9 Claims, 13 Drawing Sheets

RELATED ART

RELATED ART

LIQUID CRYSTAL DRIVING DEVICE, LIQUID CRYSTAL DISPLAY DEVICE, AND LIQUID CRYSTAL DRIVING METHOD

BACKGROUND OF THE INVENTION

1. Field of the Invention

The present invention relates to a liquid crystal driving device and method, and a liquid crystal display device for driving an active matrix type liquid crystal display panel.

2. Description of Related Art

Active matrix type liquid crystal display panels such as a TFT liquid crystal display panel have switching elements such as a TFT, liquid crystal capacitors $C_{LC}$, and an auxiliary capacitor $C_S$ at intersections between gate lines (scan lines) and data lines (signal lines) arranged in matrix. The following description focuses on the TFT liquid crystal display panel by way of example. FIG. 13 shows an equivalent circuit of the TFT liquid crystal display panel.

A TFT 110 has a gate electrode G connected to a gate line 111, a source electrode S connected to a data line 112, and a drain electrode D connected to a pixel electrode of the liquid crystal capacitors $C_{LC}$ and the auxiliary capacitor $C_S$. The liquid crystal capacitors $C_{LC}$ is a capacitor of a liquid crystal defined between the pixel electrode 113 and a common electrode 114. The auxiliary capacitor $C_S$ is used for keeping a predetermined level of voltage applied to a liquid crystal even after the voltage application to a gate was stopped. FIG. 13 shows an example where the auxiliary capacitor $C_S$ is provided between the pixel electrode 113 and the common electrode 114. However, one end of the capacitor $C_S$ may be connected with an adjacent gate line, not the common electrode.

FIG. 14 is a waveform chart of a voltage applied to a liquid crystal. FIG. 14 shows how a liquid crystal application voltage $V_{LC}$ per liquid crystal pixel changes its level from one frame to another in the case of inverting a polarity of the liquid crystal application voltage $V_{LC}$ every frame period (frame-inversion driving). Here, a gate voltage $V_G$ is a voltage applied to the gate electrode G of the TFT 110. A source voltage $V_S$ is a voltage applied to the source electrode S. A common electrode voltage (common voltage) Vcom is a voltage applied to the common electrode 114. Further, the voltage $V_{LC}$ is a voltage applied to the liquid crystal capacitor $C_{LC}$, which is equivalent to a potential difference between the pixel electrode 113 and the common electrode 114 (hereinafter, referred to as "liquid crystal application voltage"). If a DC voltage is continuously applied to the liquid crystal, a liquid crystal element could burn out and deteriorate. Hence, in driving a liquid crystal display panel, the polarity of the source voltage $V_S$ is periodically inverted to invert the polarity of the liquid crystal application voltage $V_{LC}$ at regular intervals. Such Polarity-inversion driving gives the amplitude of the source voltage $V_S$ that is twice the amplitude obtained without inverting the polarity. In some cases, as shown in FIG. 14, common-inversion driving is executed to invert the polarity of the common voltage Vcom in sync with a timing of inverting the polarity of the source voltage $V_S$ so as to obtain the amplitude of the source voltage $V_S$ equivalent to the amplitude obtained without inverting the polarity.

The liquid crystal application voltage $V_{LC}$ varies depending on a difference between the source voltage $V_S$ and the common voltage Vcom at the time of gate-off (when a potential of the gate voltage $V_G$ is switched to a "Low" level) but is unequal to the difference, to be exact. This is because, owing to the presence of a gate-drain parasitic capacitance $C_{GD}$, charges accumulated in the liquid crystal capacitors $C_{LC}$ are stored in a gate-drain parasitic capacitance $C_{GD}$, with the result that a level of the liquid crystal application voltage $V_{LC}$ is changed. To be specific, as shown in FIG. 14, a voltage shift $\Delta V1$, or $\Delta V2$, occurs with respect to the liquid crystal application voltage $V_{LC}$. Here, the voltage shift $\Delta V$ is represented by Expression 1 below.

$$\Delta V=\Delta V_G(C_{GD}/(C_{GD}+C_{LC}+C_S)) \quad \text{(Expression 1)}$$

where $\Delta V_G$ represents a variation of the gate voltage $V_G$ between in the gate-on state and in the gate-off state. As apparent from Expression 1 above, the voltage shift $\Delta V$ varies depending on a capacitance value of the liquid crystal capacitor $C_{LC}$. On the other hand, the liquid crystal application voltage $V_{LC}$ varies depending on a voltage value of the source voltage $V_S$. Accordingly, the voltage shift $\Delta V$ varies depending on the source voltage $V_S$.

Considering this example with reference to FIG. 14, an image is displayed with the same gray scale during first and second frames, so the source voltage $V_S$ is constant albeit its polarity is inverted, and an amount of the shift $\Delta V$ is constant ($\Delta V1$). However, during third and fourth frames, a gray scale of a display image is changed by changing a value of the source voltage $V_S$ from that in the second frame. As a result, the amount of the voltage shift is changed from $\Delta V1$ to $\Delta V2$.

As shown in the waveform chart of FIG. 14, a difference is caused between a voltage amplitude $V_p1$ with a positive polarity (first frame) and a voltage amplitude $V_n1$ with a negative polarity (second frame) even if an image is displayed with the same gray scale. Further, there is a difference between voltage amplitude $V_p2$ in the third frame and a voltage amplitude $V_n2$ in the fourth frame. Such a difference between the negative polarity and the positive polarity of the liquid crystal application voltage $V_{LC}$ causes not only flickering of a display image but burning due to the application of the DC voltage to the liquid crystal. Incidentally, such a difference between the negative polarity and the positive polarity of the liquid crystal application voltage $V_{LC}$ due to the voltage shift $\Delta V$ is also caused in the case where the auxiliary capacitor $C_S$ is defined between the pixel electrode 113 and an adjacent gate line.

To that end, there has been proposed a technique of eliminating the difference between the negative polarity and the positive polarity of the liquid crystal application voltage $V_{LC}$, in other words, removing DC components of the liquid crystal application voltage $V_{LC}$ by adjusting the common voltage Vcom. For example, Japanese Unexamined Patent Application Publication No. 2000-267618 discloses a liquid crystal display device that adjusts a DC voltage level of the common voltage Vcom based on a video signal voltage for displaying an image on a liquid crystal display panel to reduce a voltage difference between the negative polarity and the positive polarity of the liquid crystal application voltage $V_{LC}$. A technique of adjusting the source voltage $V_S$ to remove the DC components of the liquid crystal application voltage $V_{LC}$ has been also proposed (see Japanese Unexamined Patent Application Publication No. 2003-114659).

As mentioned above, there has been known the liquid crystal display device that adjusts a value of the common voltage Vcom to remove the DC components of the voltage liquid crystal application voltage $V_{LC}$ to eliminate the difference between the negative polarity and the positive polarity of the voltage $V_{LC}$. However, the known liquid crystal display device has a problem that a timing of adjusting the value of the common voltage Vcom for removing the DC components of the liquid crystal application voltage $V_{LC}$ cannot be controlled.

For example, Japanese Unexamined Patent Application Publication No. 2000-267618 discloses a technique of amplifying an average picture level (APL) signal corresponding to an average voltage in one frame period of a image display signal, and overlapping the amplified APL signal on an output of a common electrode driving amplifier for driving a common electrode to adjust a center voltage of the common voltage Vcom. However, in the structure disclosed in Japanese Unexamined Patent Application Publication No. 2000-267618, a horizontal or vertical control signal generated by an LCD controller is not referenced upon adjusting the common voltage Vcom.

In the structure disclosed in Japanese Unexamined Patent Application Publication No. 2000-267618, the timing corresponding to a vertical clock signal V and horizontal clock signal H extracted from the input image display signal is different from the driving timing of a signal driver and scan driver at the actual display time of the liquid crystal display panel. This is because the signal driver and scan driver drive a data line or gate line through a processing for moving input image data to an output position, and a processing for converting the input image data into a signal voltage applied to the liquid crystal. Thus, in the structure disclosed in Japanese Unexamined Patent Application Publication No. 2000-267618 where the horizontal or vertical control signal generated by the LCD controller is not referenced upon adjusting the common voltage Vcom, the timing of adjusting the common voltage Vcom cannot be decided in consideration of the timing of driving the data line or gate line. Hence, it is difficult for the structure disclosed in Japanese Unexamined Patent Application Publication No. 2000-267618 to adjust the common voltage Vcom under control exclusively during a blanking period in which neither data lines nor gate lines in a display area of the liquid crystal display panel are driven. Therefore, there is a possibility that the common voltage Vcom changes in the middle of displaying an image on the liquid crystal display panel.

If the common voltage Vcom is changed during a period (scanning period) in which an image is being displayed on the liquid crystal display panel, without controlling the timing of adjusting the common voltage Vcom, flickering occurs in a display image due to an abrupt luminance change, leading to deterioration of an image quality. Therefore, it is desirable to control the timing of adjusting the common voltage Vcom such that the adjustment is carried out during the blanking period.

SUMMARY OF THE INVENTION

The present invention has been accomplished in view of the above problems, and accordingly, it is an object of the present invention to suppress flickering in an image displayed on a liquid crystal display panel.

In a liquid crystal driving device for driving an active matrix type liquid crystal display panel according to an aspect of the invention, a common electrode voltage value that is a value of a voltage applied to a common electrode of the liquid crystal display panel is determined based on input image data, and a timing of changing a voltage applied to the common electrode to the common electrode voltage value is determined based on a timing of driving at least one of a scan line and a signal line of the liquid crystal display panel.

On the other hand, in an active matrix type liquid crystal display device according to another aspect of the invention, a common electrode voltage value that is a value of a voltage applied to a common electrode of the liquid crystal display panel is determined based on input image data, and a timing of changing a voltage applied to the common electrode to the common electrode voltage value is determined based on a timing of driving at least one of a scan line and a signal line of the liquid crystal display panel.

Further, a liquid crystal driving method for driving an active matrix type liquid crystal display panel according to another aspect of the invention includes: determining a common electrode voltage value that is a value of a voltage applied to a common electrode of the liquid crystal display panel based on input image data, and determining a timing of changing a voltage applied to the common electrode to the common electrode voltage value based on a timing of driving at least one of a scan line and a signal line of the liquid crystal display panel.

The above structure or driving method of the present invention makes it possible to change a common electrode voltage value in consideration of a timing of displaying an image on the liquid crystal display panel. Accordingly, a preset value of the common electrode voltage can be changed during such a period that no image is displayed on the liquid crystal display panel. Consequently, it is possible to suppress flickering in a display image due to the abrupt luminance change.

According to the present invention, it is possible to provide a liquid crystal driving device, a liquid crystal display device, and a liquid crystal driving method, which can suppress the flickering in an image displayed on a liquid crystal display panel by controlling a timing of changing a level of voltage applied to the common electrode.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

First Embodiment

Figure 1:
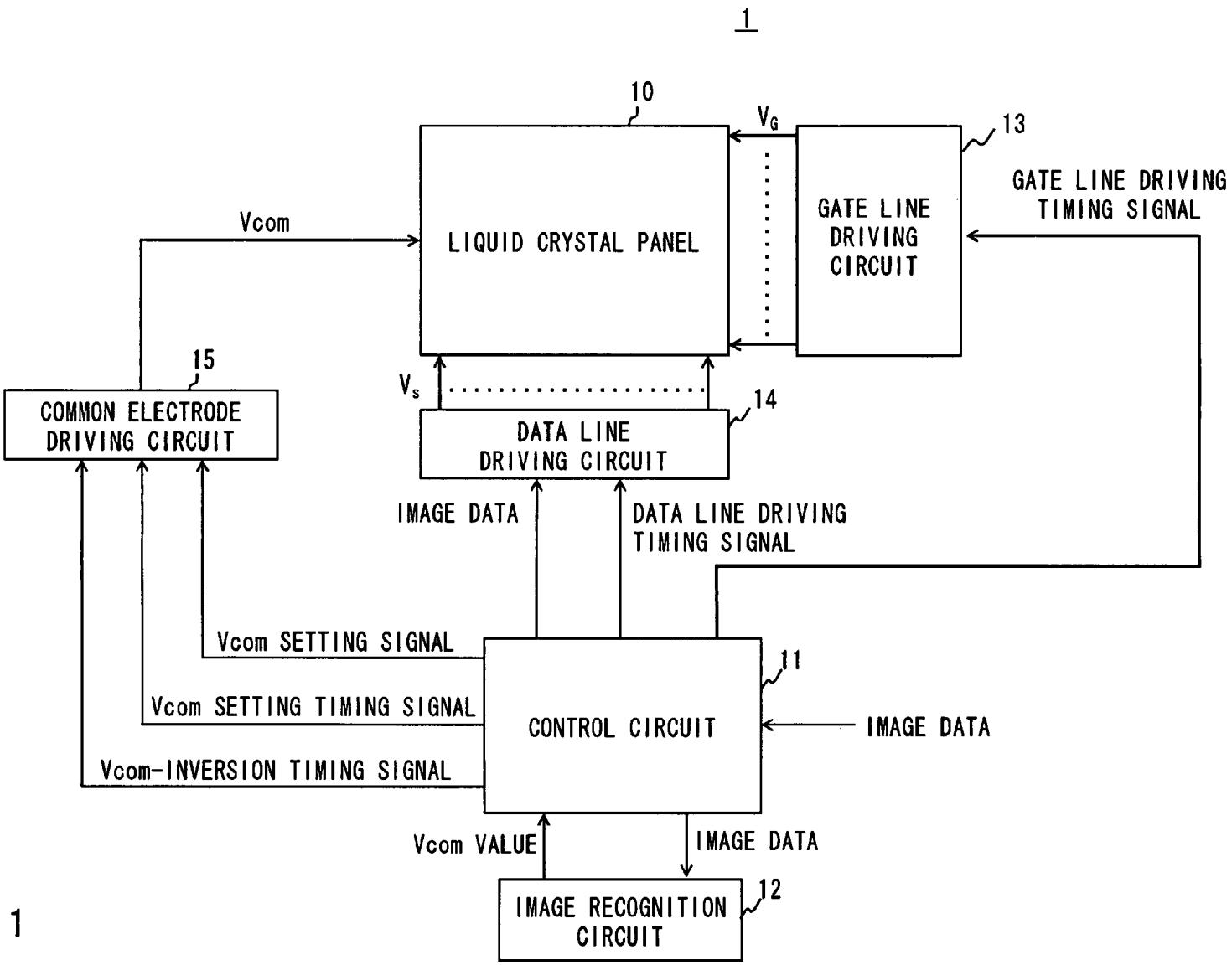
FIG. 1 is a diagram showing a liquid crystal display device according to a first embodiment of the present invention.
Figure 13:
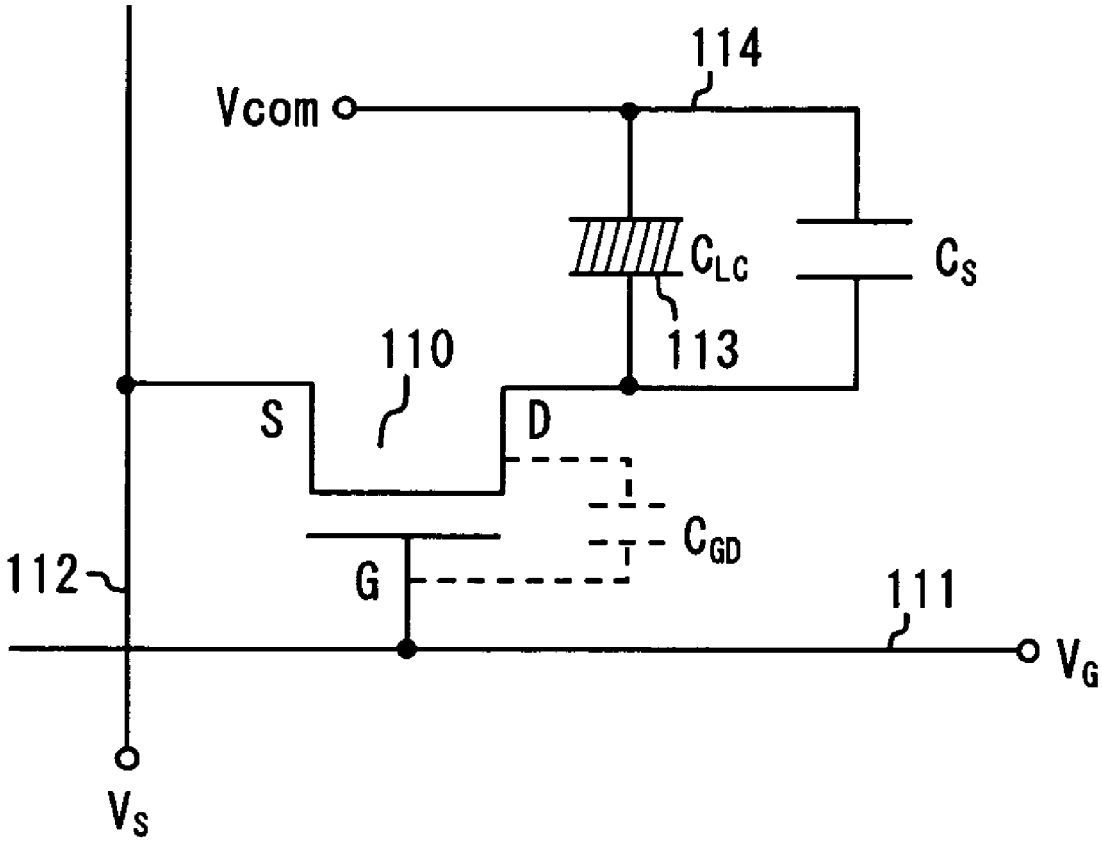
FIG. 13 shows an equivalent circuit of a liquid crystal display panel of the related art.
Figure 14:
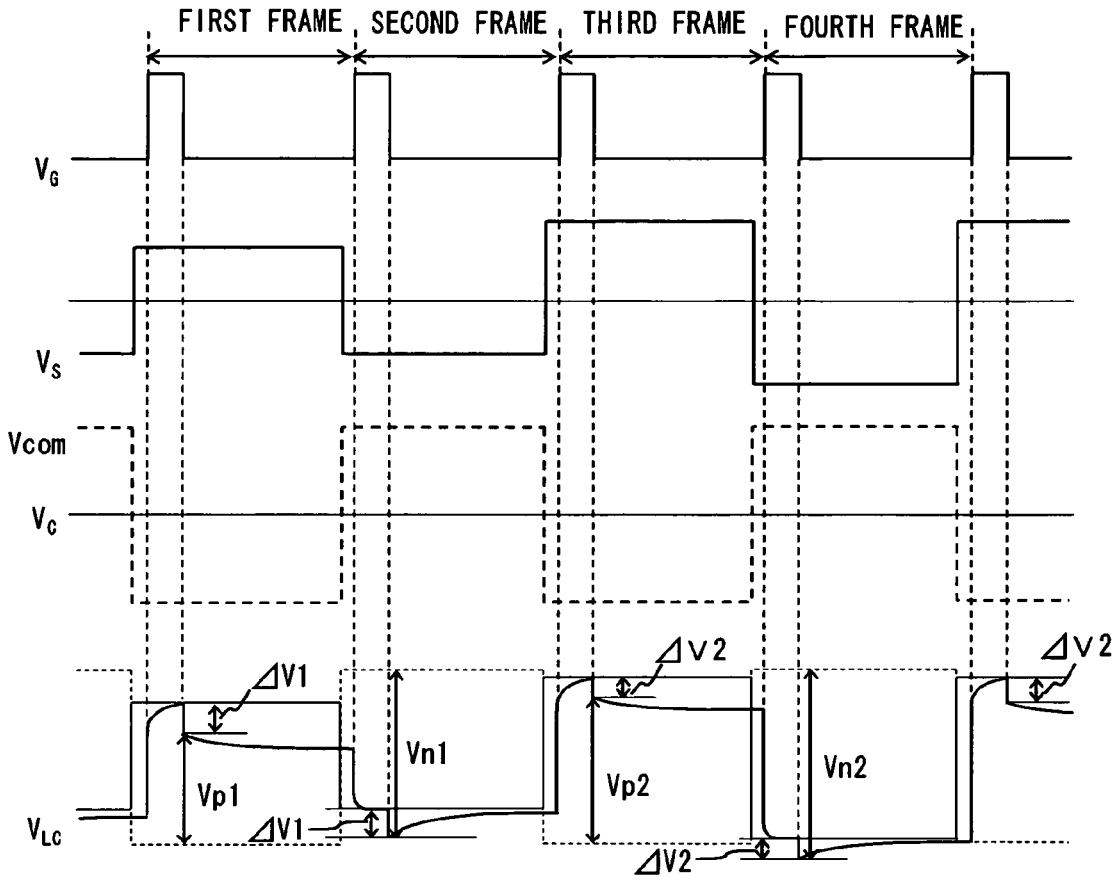
Fig. 14 RELATED ART
FIG. 14 is a waveform chart of a voltage for driving a liquid crystal display device of the related art.

Referring to FIG. 1, the structure of a liquid crystal display device 1 according to a first embodiment of the present invention is described. A liquid crystal display panel 10 is an active matrix type liquid crystal display panel using a TFT as a switching element, and has the same structure as the liquid crystal display panel of the related art illustrated in FIG. 13. In short, in the liquid crystal display panel 10, plural gate lines 111 and plural data lines 112 are arranged in matrix. At intersections between the gate lines 111 and the data lines 112, liquid crystal pixels are provided, which includes a TFT 110, a pixel electrode 113, a common electrode 114, a liquid crystal capacitor $C_{LC}$, and an auxiliary capacitor $C_S$. The liquid crystal display panel 10 is driven with a gate voltage $V_G$, source voltage $V_S$, and common voltage Vcom applied by a gate line driving circuit 13, a data line driving circuit 14, and a common electrode driving circuit 15, respectively.

A control circuit 11 outputs a gate line driving timing signal indicating a timing of driving the gate line 111 to the gate line driving circuit 13. On the other hand, the control circuit 11 outputs a data line driving timing signal to the data line driving circuit 14. The data line driving timing signal indicates a timing of driving plural data lines 112 with gray-scale voltage corresponding to image data. Further, a Vcom inversion timing signal indicating a Vcom polarity inversion period is output to the common electrode driving circuit 15. The Vcom inversion timing signal indicates a polarity inversion period corresponding to a liquid crystal application voltage $V_{LC}$ polarity-inversion driving method such as frame-inversion driving, line-inversion driving, and dot-inversion driving.

Further, the control circuit 11 outputs to the common electrode driving circuit 15 a Vcom setting signal indicating a preset value of a common voltage (Vcom set value) and a Vcom setting timing signal indicating a timing of adjusting a Vcom set value.

An image recognition circuit 12 determines a Vcom set value based on externally supplied image data. Here, the Vcom set value is a reference value of the common voltage Vcom applied by the common electrode driving circuit 15. For example, the Vcom set value may be a value that determines a center voltage (DC voltage level) of the common voltage Vcom subjected to polarity inversion. Further, the Vcom set value is determined to eliminate the difference between the negative polarity and the positive polarity of the liquid crystal application voltage $V_{LC}$, that is, remove the DC components of the liquid crystal application voltage $V_{LC}$. A detailed procedure for determining the Vcom set value is described below.

The gate line driving circuit 13 applies the gate voltage $V_G$ to the plural gate lines 111 of the liquid crystal display panel 10 in order in accordance with the gate line driving timing signal sent from the control circuit 11.

The data line driving circuit 14 receives image data from the control circuit 11, and applies the source voltage $V_S$ to the plural data lines 112 of the liquid crystal display panel 10 in accordance with the data line driving timing signal sent from the control circuit 11.

The common electrode driving circuit 15 applies the common voltage Vcom to the common electrode 114 of the liquid crystal display panel 10. The Vcom inversion timing for common-inversion driving is determined with reference to the Vcom inversion timing signal from the control circuit 11. The Vcom inversion timing signal indicates a polarity-inversion period corresponding to the liquid crystal application voltage $V_{LC}$ polarity-inversion driving such as frame-inversion driving, line-inversion driving, and dot-inversion driving.

In the liquid crystal display device 1 according to this embodiment, the control circuit 11 outputs the gate line driving timing signal, the data line driving timing signal, the Vcom inversion timing signal, and the Vcom setting timing signal in sync. The gate line driving circuit 13, the data line driving circuit 14, and the common electrode driving circuit 15 apply the voltage to the liquid crystal display panel 10 in accordance with timings indicated by the timing signals. In this way, the control circuit 11 collectively controls a timing of displaying an image on the liquid crystal display panel 10 by driving the gate line and the data line and a timing of adjusting the Vcom value, making it possible to adjust the Vcom set value in consideration of a timing of displaying an image on the liquid crystal display panel 10. Therefore, the liquid crystal display device 1 can control the Vcom value adjustment timing such as setting a Vcom value in a blanking period.

Figure 2:
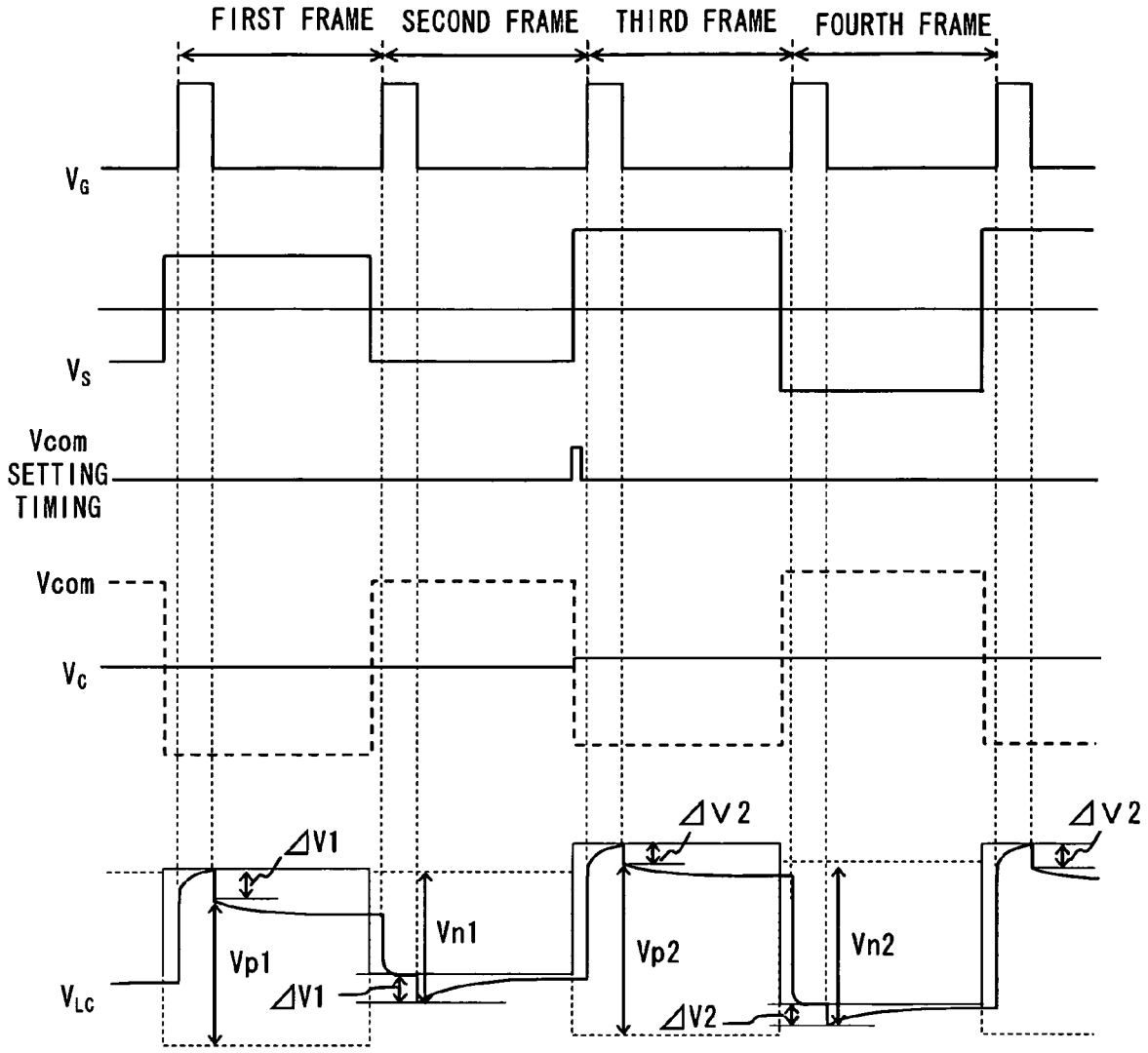
FIG. 2 is a waveform chart of a voltage for driving the liquid crystal display device of FIG. 1.
Figure 3:
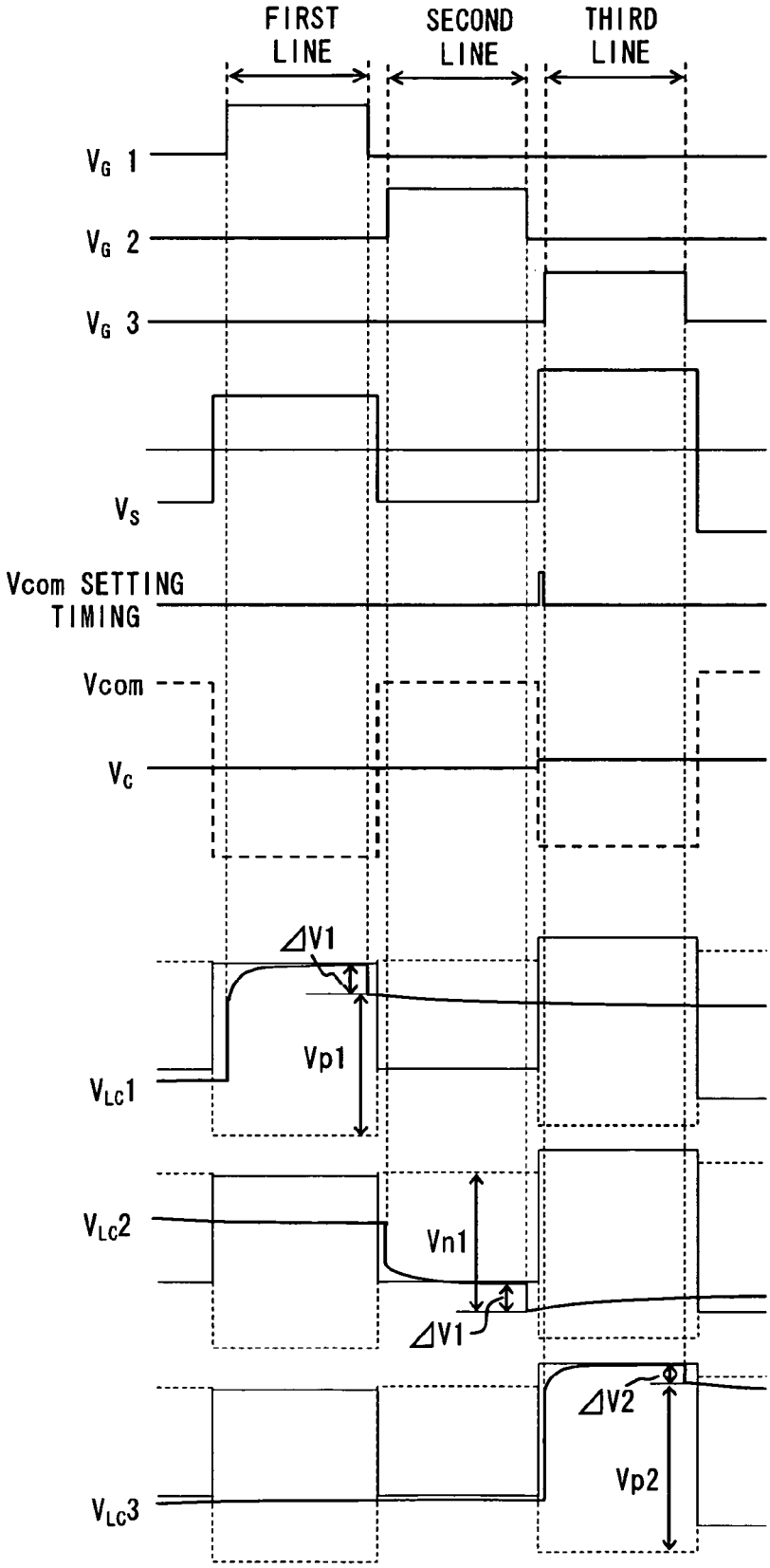
FIG. 3 is a waveform chart of a voltage for driving the liquid crystal display device of FIG. 1.

Next, a driving voltage waveform of the liquid crystal display device 1 according to this embodiment is described with reference to FIGS. 2 and 3. FIG. 2 is a driving voltage waveform chart of the liquid crystal display device 1 for adjusting a Vcom value on a frame basis. In FIGS. 2 and 3, Vc represents a center voltage of the common voltage Vcom subjected to polarity inversion. The waveform of the Vcom setting timing shows a timing at which the common electrode driving circuit 15 adjusts the Vcom value and which is determined by the Vcom setting timing signal. In the waveform chart of FIG. 2, during the first and second frames, an image is displayed with the same gray scale during first and second frames, so the source voltage $V_S$ is constant albeit its polarity is inverted, and an amount of the shift ΔV is constant (ΔV1). The Vcom center voltage Vc is adjusted not to cause a difference between a voltage amplitude $V_p$1 with a positive polarity (first frame) and a voltage amplitude $V_n$1 with a negative polarity (second frame).

On the other hand, the source voltage $V_S$ is changed between the second frame and the third frame, and an amount of the voltage shift ΔV is accordingly changed from ΔV1 to ΔV2 (ΔV1>ΔV2). In such a case, the control circuit 11 sends Vcom setting timing signal and the Vcom setting signal to the common electrode driving circuit 15 so as to adjust the Vcom center voltage Vc in the blanking period between the second frame and the third frame. The common electrode driving circuit 15 changes the center voltage Vc in the blanking period during the second frame and the third frame in response to the Vcom setting timing signal and the Vcom setting signal. With this operation, even in the third frame and the fourth frame where the amount of the voltage shift ΔV is shifted from ΔV1 to ΔV2, the panel can be driven without causing a difference between the voltage amplitude $V_{p2}$ with a positive polarity (third frame) and a voltage amplitude $V_{n2}$ with a negative polarity (fourth frame). Thus, the difference between the negative polarity and the positive polarity in the liquid crystal application voltage $V_{LC}$ is suppressed even when the amount of the voltage shift ΔV is changed.

FIG. 3 is a driving voltage waveform chart of the liquid crystal display device 1 in the case of adjusting the Vcom value on a line (horizontal scanning period) basis during the line-inversion driving. In FIG. 3, $V_G$1 to $V_G$3 represent gate voltages corresponding to three consecutive lines (first to third lines), and $V_{LC}$1 to $V_{LC}$3 represent voltages applied to liquid crystal pixels on the first to third lines. The liquid crystal pixels on the first and second lines display an image of the same gray scale, and a difference between the source voltage $V_S$ and the common electrode voltage Vcom is uniform therebetween albeit the polarity is inverted. The Vcom center voltage Vc is adjusted not to cause a difference between the voltage amplitude $V_p$1 with the positive polarity (first line) and the voltage amplitude $V_n$1 with the negative polarity (first line).

On the other hand, a gray scale level is changed between the second line and the third line to change the source voltage Vs. Along with the change, the amount of the voltage shift ΔV is changed from ΔV1 to ΔV2 (ΔV1>ΔV2). In this case, the control circuit 11 sends the Vcom setting timing signal and Vcom setting signal to the common electrode driving circuit 15 to adjust the Vcom center voltage Vc in the horizontal blanking period between the second line and the third line. With this operation, in the third line where the amount of the voltage shift ΔV is changed from ΔV1 to ΔV2, the difference between the positive polarity and the negative polarity of the liquid crystal application voltage $V_{LC}$ is suppressed.

Figure 4:
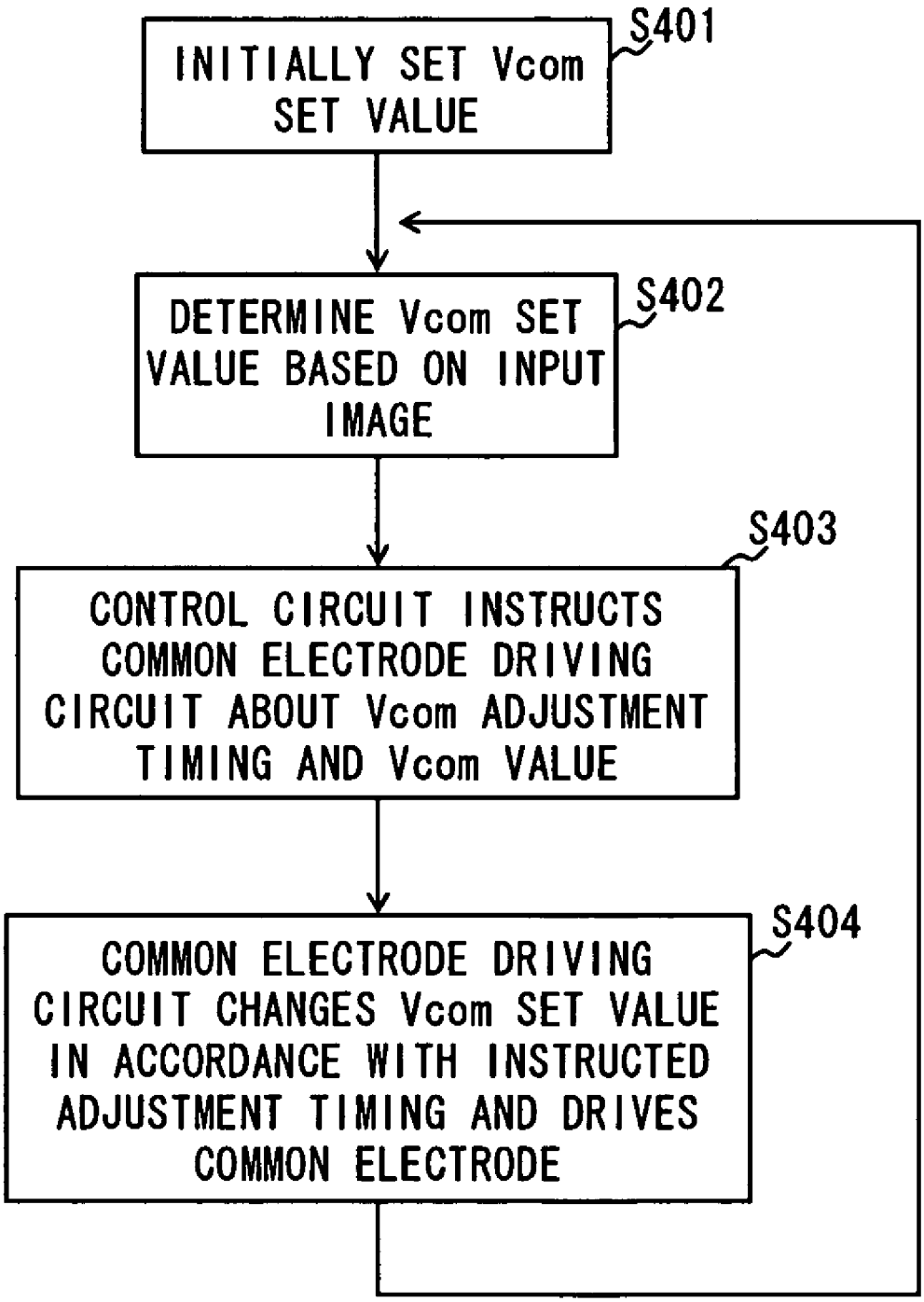
FIG. 4 is a flowchart of an overall operation of the liquid crystal display device of FIG. 1.

Next, the processing of determining the Vcom set value executed in the control circuit 11 and the image recognition circuit 12 is described with reference to FIGS. 4 to 9. FIG. 4 is a flowchart of a processing from determining the Vcom set value to driving the common electrode 114 in the liquid crystal display panel 10 based on the Vcom set value. First, in the initial setting of the Vcom value in step S401, the Vcom set value corresponding to the gray scale of the image data is predetermined in the image recognition circuit 12. The initial set value is determined by setting the Vcom center voltage (DC voltage level) as the Vcom set value in association with the gray scale of the image data. The amount of the voltage shift ΔV varies depending on the gray scale of the image data. Hence, the Vcom center voltage (DC voltage level) may be determined to eliminate a voltage amplitude difference between the positive polarity and negative polarity of the liquid crystal application voltage $V_{LC}$ which occurs upon displaying the image data of each gray scale.

In step S402, the image recognition circuit 12 determines the Vcom set value based on the input image data and outputs the Vcom set value to the control circuit 11. Incidentally, a method of determining the Vcom set value is described in detail below.

In step S403, the control circuit 11 instructs the common electrode driving circuit 15 about the Vcom set value input from the image recognition circuit 12 and a timing of adjusting the Vcom set value (Vcom setting timing signal). An instruction is issued to the common electrode driving circuit 15 by outputting the Vcom setting signal and the Vcom setting timing signal. Finally, in step S404, the common electrode driving circuit 15 changes the Vcom center voltage based on the Vcom setting timing and the Vcom set value sent from the control circuit 11 and supplies the adjusted common voltage Vcom to the common electrode 113. With this processing, the common voltage Vcom can be adjusted.

Figure 5:
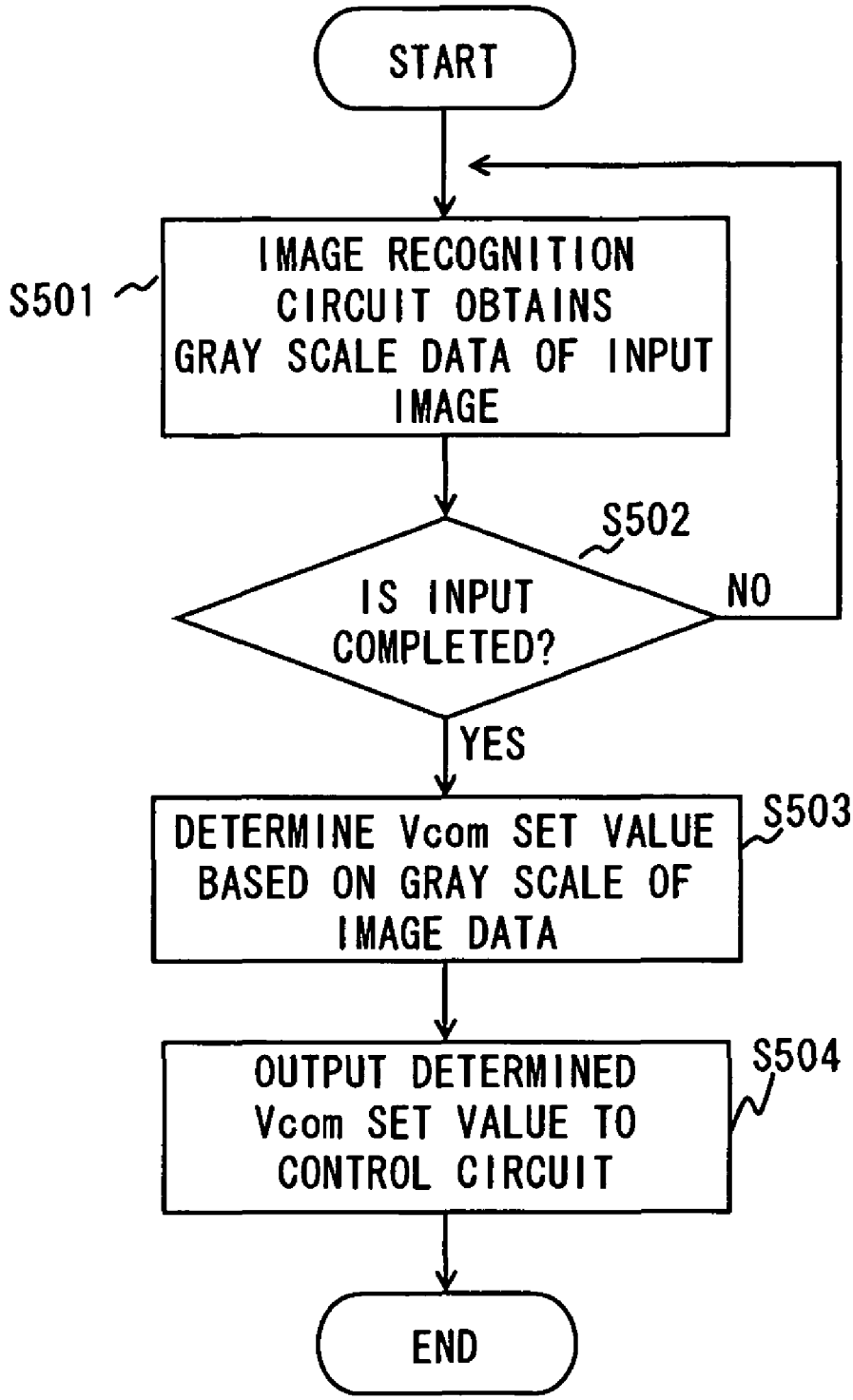
FIG. 5 is a flowchart of a processing of determining a common voltage Vcom value in the liquid crystal display device of FIG. 1.
Figure 6:
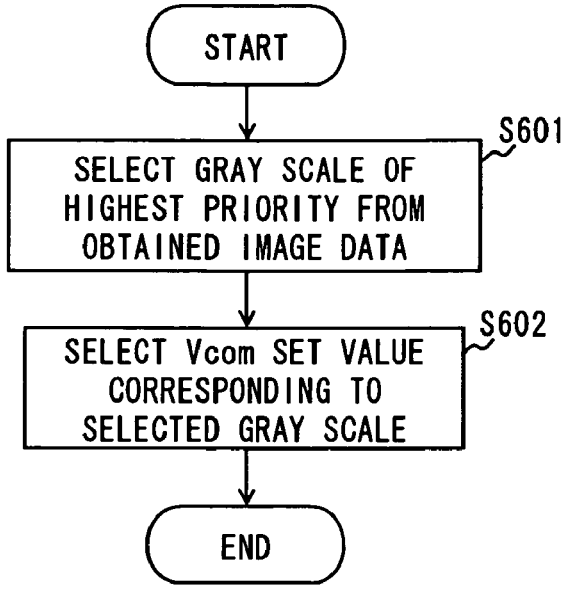
FIG. 6 is a flowchart showing a specific example of the processing of determining a common voltage Vcom value.
Figure 7:
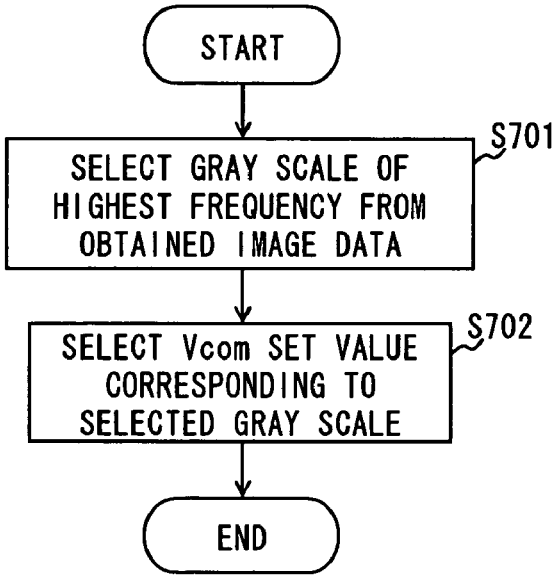
FIG. 7 is a flowchart showing a specific example of the processing of determining a common voltage Vcom value.
Figure 8:
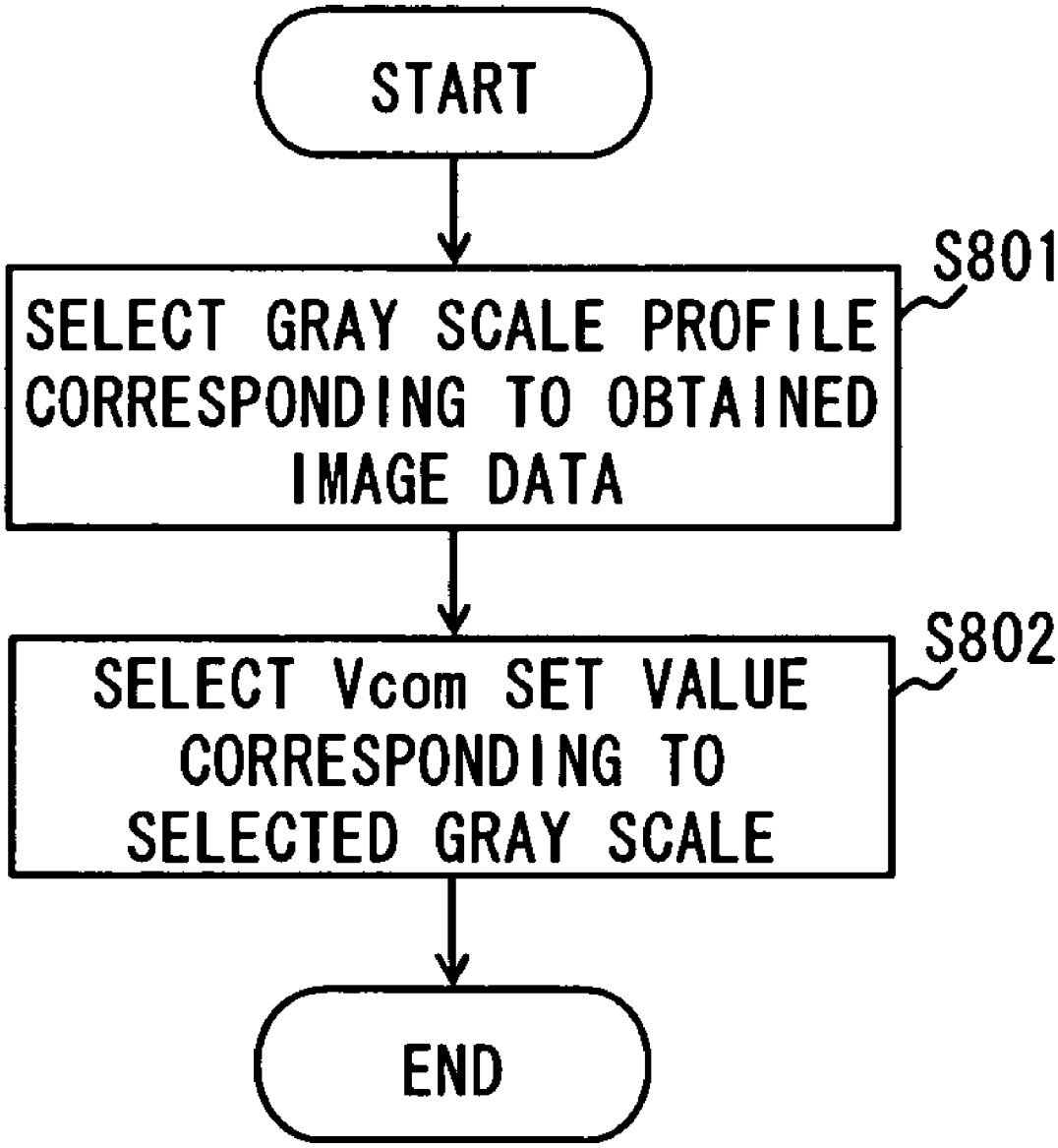
FIG. 8 is a flowchart showing a specific example of the processing of determining a common voltage Vcom value.
Figure 9A:
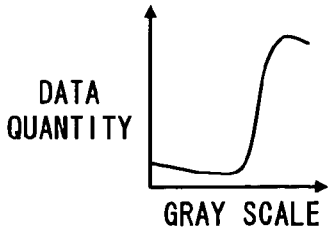
FIGS. 9A to 9E are diagrams each showing a specific example of a gray scale profile.
Figure 9B:
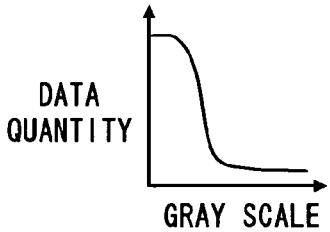
Figure 9C:
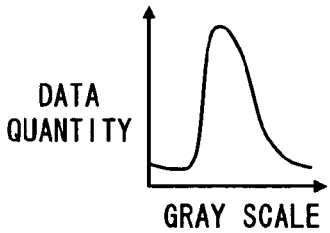
Figure 9D:
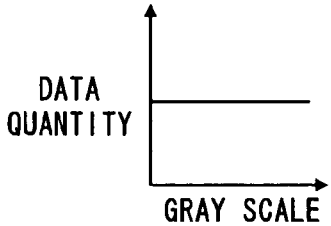
Figure 9E:
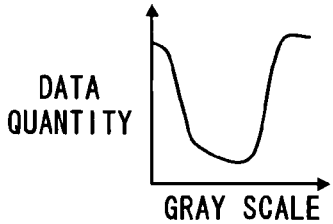

Next, the processing of determining the Vcom set value in step S402 is described in detail with reference to FIG. 5. In step S501, the image recognition circuit 12 obtains the gray scale of the image data input to the control circuit 11 in order. The processing of step S501 is repeated until the image data corresponding to a predetermined time period (one frame, one line, etc.) has been input (step S502). Incidentally, the predetermined period (obtainment period) during which the image recognition circuit 12 obtains the image data can be arbitrarily set. The image data is typically obtained on a frame basis or on a line basis, but may be obtained on the basis of frame and line. Alternatively, the obtainment period may be changed depending on whether or not the input image is a moving image or still image.

In step S503, the image recognition circuit 12 determines the Vcom set value following a preset determination procedure based on the gray scale of the obtained image data. The determined Vcom set value is output to the control circuit 11. Here, a specific example of the processing procedure in step S503 is described with reference to FIGS. 6 to 8. The following specific examples (Examples 1 to 4) are used for illustrative purposes. To sum up, the Vcom set value may be determined based on the image data to eliminate the difference between the positive polarity and the negative polarity of the liquid crystal application voltage $V_{LC}$ which would occur due to the voltage shift ΔV. Alternatively, the Vcom set value may be determined with any other processing procedure.

Example 1

FIG. 6

First of all, the gray scales of the image data are prioritized in advance. For example, the gray scale where flickering noticeably occurs due to the difference between the positive polarity and the negative polarity of the liquid crystal application voltage $V_{LC}$ is given a high priority. The gray scale where flickering is less noticeable is given a low priority. At the time of determining the Vcom set value, the gray scale that is given the highest priority of all gray scales in the image data is selected (step S601), and the Vcom set value corresponding to the gray scale of the highest priority is selected with reference to the relation between the gray scale initially set in step S401 and the Vcom set value (step S602). Note that all the gray scales may be prioritized, but only the gray scales that are particularly susceptible to flickering may be prioritized without prioritizing the remaining gray scales, and a uniform value is set as the Vcom set value for the remaining gray scales. Hence, the common voltage Vcom can be corrected with reference to an image of the highest priority, that is, an image that is most susceptible to flickering, not an average value of the whole image. Therefore, an image that is reduced flickers can be displayed.

Example 2

FIG. 7

First, the gray scale that is most frequently used (appears at a high frequency) of all gray scales in the image data is selected (step S701). Then, the Vcom set value corresponding to the gray scale of the highest frequency is selected with reference to the relation between the gray scale initially set in step S401 and the Vcom set value (step S702).

Hence, the common voltage Vcom can be corrected in accordance with the gray scale of the highest frequency of appearance, in short, the most noticeable gray scale, so an image that is reduced flickers can be displayed.

Example 3

As a modification of Example 2, it is possible to determine the Vcom set value depending on the gray scale of a higher frequency for each of R, G, and B. In this case, as a method of adding the frequency of the input data, it is possible to add the frequency through weighting (0.299×R, 0.587×G, 0.114×B) while considering the relation between RGB signals and luminance signal. The reason the gray scales are prioritized for each of R, G, and B is that a luminance varies among R, G, and B. If flickering occurs in an image of a higher luminance, this flickering is conspicuous. Hence, this example has an effect of suppressing the flicking in the image of a higher luminance.

Example 4

FIG. 8

To begin with, the initial setting is performed in step S401 by determining the Vcom set value with respect to the gray scale profile pattern of the image data input during a predetermined period. Here, the gray scale profile pattern is obtained by classifying the image data according to the gray scale characteristics. For example, as shown in FIGS. 9A to 9E, gray scale profiles corresponding to a bright image (FIG. 9A), a dark image (FIG. 9B), an image of an intermediate gray scale, an image of an average gray scale profile (FIG. 9D), and an image of high contrast (FIG. 9E) are obtained to determine the Vcom set value corresponding to the grayscale profile. In determining the Vcom set value, it is determined which gray scale profile out of the predetermined gray scale profiles corresponds to a gray scale profile of the image data obtained with the image recognition circuit 12 (step S801) to select the Vcom set value corresponding to the determined gray scale profile with reference to the relation between the initially set gray scale profile and the Vcom set value (step S802). A relation between the image characteristic and flickering shows that flickering is conspicuous with a gray scale representing a bright luminance in the case of displaying a dark image, while the flickering is conspicuous with a gray scale representing a medium luminance in the case of displaying a bright image. In this embodiment, the common voltage Vcom can be corrected according to the gray scale in which flickering is especially conspicuous among gray scales contained in the image data.

Referring back to FIG. 5, in the final step S504, the image recognition circuit 12 outputs the Vcom set value to the control circuit 11. Through these series of processings, the Vcom set value can be determined based on the gray scale of the image data.

Incidentally, in the liquid crystal display device 1 according to this embodiment, the Vcom setting timing indicated by the control circuit 11 may be changed to change an adjustment period for the common voltage Vcom. The Vcom value may be adjusted (1) on a line basis (each horizontal scanning period), (2) on a frame basis (each vertical scanning period), (3) on the basis of line and frame, and (4) on the basis of given area.

(1) In the case of adjusting the Vcom value on a line basis, finer adjustment can be performed compared to the frame basis adjustment as mentioned below. Hence, an effect of suppressing flickering is greater than that of the Vcom adjustment on the frame basis. However, if the adjusted Vcom value varies between the lines, the liquid crystal application voltage $V_{LC}$ is changed when the same source voltage $V_S$ is applied. Thus, a variation may occur between the lines in the case of displaying the image data of the same gray scale.

(2) In adjusting the Vcom value on a frame basis, the number of times the adjustment is carried out is smaller than the adjustment on the line basis, so an effect of suppressing flickering is small. However, a common voltage level is constant in one screen, so the variation that occurs in the case of applying the same source voltage Vs is less than the adjustment on the line basis.

(3) It is possible to perform an irregular adjustment on the basis of frame and line such as adjusting one image on a frame basis and adjusting the next image on a line basis. The Vcom value can be adjusted in sync with a common voltage inversion period at the case of combined inversion-driving that alternately repeats the frame inversion and line inversion of polarities of the liquid crystal application voltage and the common voltage.

(4) Further, it is possible to divide one screen into an arbitrary number of areas to adjust the Vcom value on the basis of area. For example, one screen may be divided into four areas in a horizontal direction or into a central portion (first area) and the other portion (second area) to adjust the Vcom value for each area.

According to the foregoing technique of Japanese Unexamined Patent Application Publication No. 2000-267618, the Vcom value is adjusted based on an average value of image data in one frame period. However, in the case of displaying an image as shown in FIG. 15, for example, the flickering is noticeable in the display image if the Vcom value is corrected based on an average value of image data in one frame period, that is, one screen.

Figure 15:
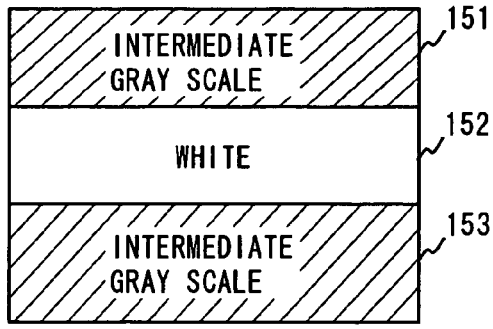
FIG. 15 illustrates a problem to be solved by the invention.

FIG. 15 shows an example of a display image displayed on a liquid crystal display panel. An intermediate portion 152 in the screen is displayed in white with a high luminance, and an upper portion 151 and a lower portion 153 of the screen are displayed with an intermediate gray scale. To take the average throughout a screen, the average gray scale of the screen is higher than the intermediate gray scale of the upper portion 151 and the lower portion 153 due to the presence of the white portion 152. As a result, in adjusting the common voltage Vcom based on the average gray scale, there is a threat that a difference between the negative polarity and the positive polarity of the liquid crystal application voltage $V_{LC}$ further increases, and the flickering in the intermediate gray scale is emphasized. Therefore, the Vcom value is desirably adjusted not only on the basis of frame corresponding to one screen, but also on the basis of period shorter than one frame period, such as on the basis of line (one horizontal scanning period) or area obtained by dividing, one screen into plural areas.

In the liquid crystal display device 1 according to this embodiment, the voltage applied to the common electrode 114 of the liquid crystal display panel 10 can be adjusted on the basis of period shorter than one frame period, so flicking in the display image can be suppressed.

FIG. 1 shows a common voltage adjustment timing of the common electrode driving circuit 15 with the Vcom setting timing signal. However, as long as the Vcom inversion timing signal is output to invert the polarity of the Vcom during the blanking period, the control circuit may output only the Vcom setting signal and the Vcom inversion timing signal to the common electrode driving circuit 15. Even with such a structure, the common electrode driving circuit 15 executes the adjustment of the Vcom value concurrently with the Vcom polarity inversion based on the Vcom inversion timing signal, so the Vcom set value can be adjusted during the blanking period. Incidentally, the Vcom value adjustment period may be changed by the control circuit 11 changing the output cycle of the Vcom setting signal.

Second Embodiment

Figure 10:
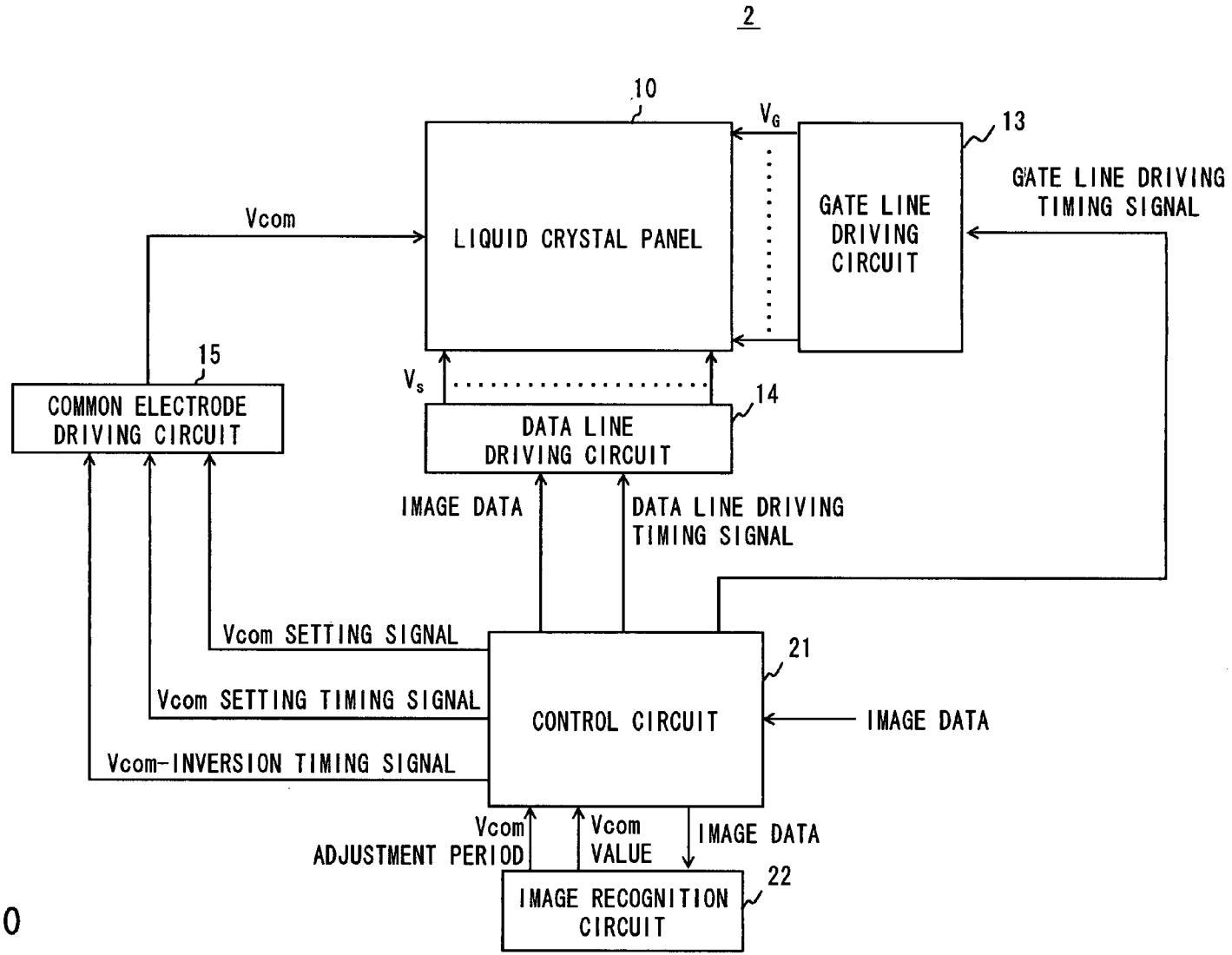
FIG. 10 is a diagram showing a liquid crystal display device according to a second embodiment of the present invention.

FIG. 10 shows the structure of a liquid crystal display device 2 according to this embodiment. An image recognition circuit 22 determines the Vcom set value based on the received image data similar to the image recognition circuit 12, and determines the adjustment period for adjusting the common voltage Vcom in accordance with the image data. The control circuit 21 is notified of the determined Vcom adjustment period together with the Vcom value. The control circuit 21 outputs the Vcom setting timing signal to a common electrode driving circuit 15 in accordance with the Vcom adjustment period notified by the image recognition circuit 22. The other operation of the control circuit 21 is the same as the control circuit 11 according to the first embodiment. Other components of the liquid crystal display device 2 are the same as those of the liquid crystal display device 1 according to the first embodiment and thus denoted by like reference numerals, and their description is omitted.

Figure 11:
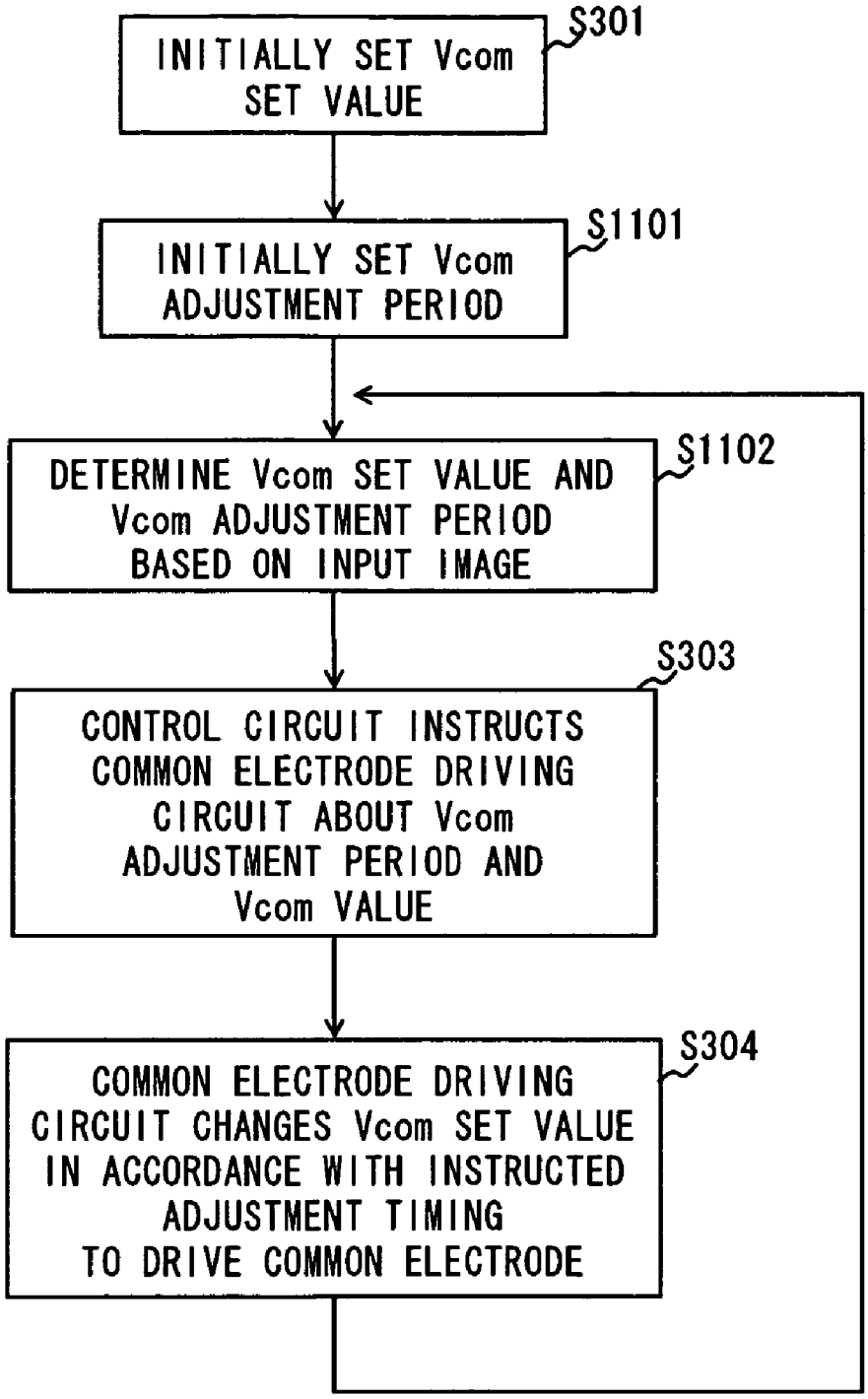
FIG. 11 is a flowchart of an overall operation of the liquid crystal display device of FIG. 10.

The overall processing of the liquid crystal display device 2 is described with reference to a flowchart of FIG. 11. The same steps as those of the overall processing of the liquid crystal display device 1 are denoted by like reference symbols, and their description is omitted. In step S1101, the Vcom adjustment period corresponding to the image data is initially set. For example, the adjustment period for a moving image, and the adjustment period for a still image are individually set be forehand. In step S1102, the image recognition circuit 22 determines the Vcom set value and the Vcom adjustment period based on the received image data to output the value and period to the control circuit 21.

Figure 12:
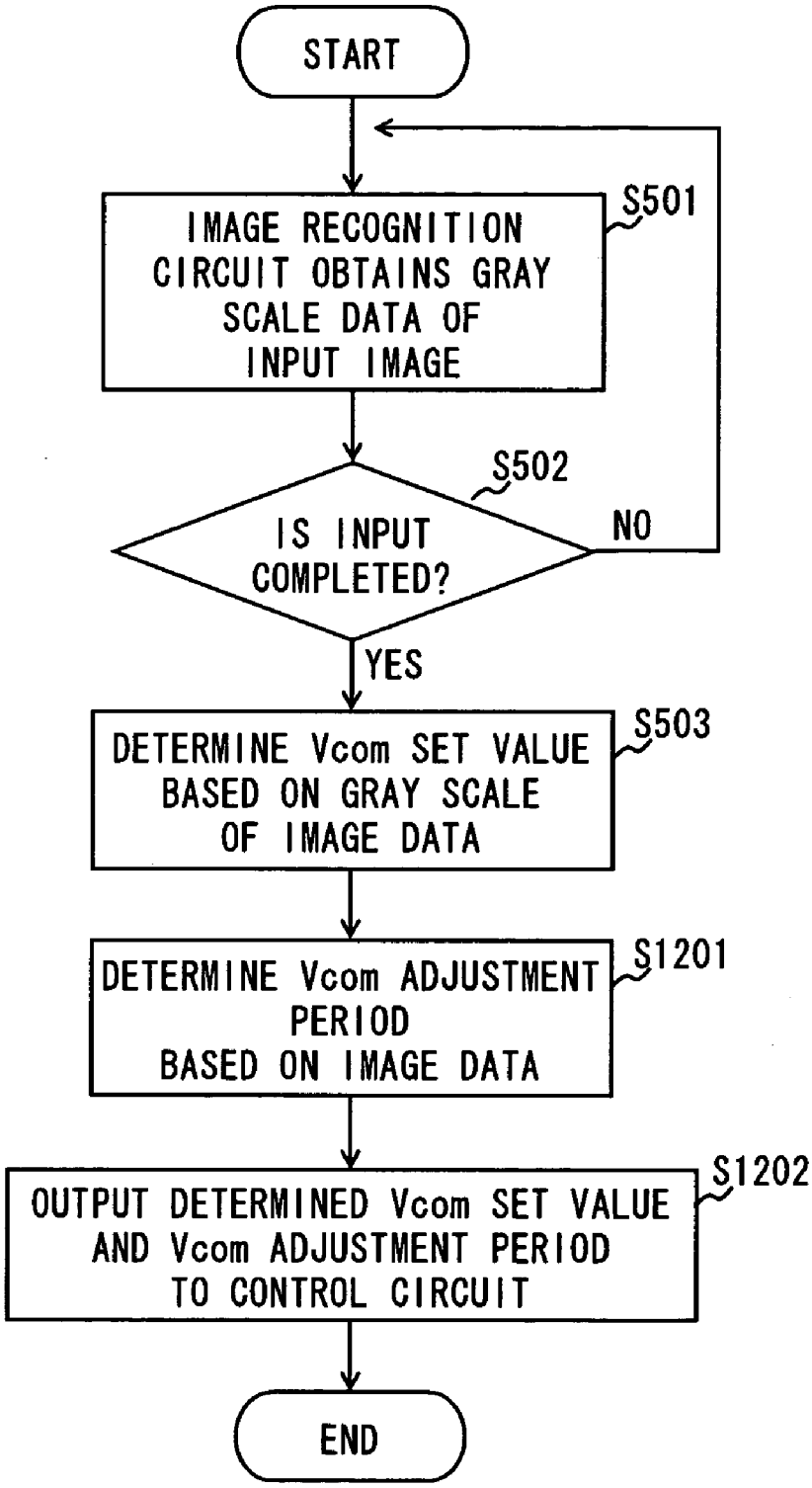
FIG. 12 is a flowchart of a processing of determining a common voltage Vcom value in the liquid crystal display device of FIG. 10.

Referring next to FIG. 12, the processing of determining the Vcom set value and the Vcom adjustment period in step S1102 is described in detail. The same steps as those of the processing of determining the Vcom set value in the image recognition circuit 12 as shown in FIG. 5 are denoted by like reference symbols, and their description is omitted.

After the Vcom set value is determined in step S503, in step S1201, the Vcom adjustment period is determined based on the input image data. This determination may be carried out by comparing the gray scales of the image data obtained in steps S501 to S503 with the gray scale of the image data in a previous frame to determine whether the image is a moving image or a still image based on whether or not the gray scale is changed. Then, a suitable one corresponding to the determined image data is selected from the initially set adjustment periods. In a subsequent step, S1202, the image recognition circuit 22 outputs the Vcom set value and the Vcom adjustment period to the control circuit 21.

With such a structure, the liquid crystal display device 2 can change the adjustment period of the Vcom value based on the received image data.

It is apparent that the present invention is not limited to the above embodiment that may be modified and changed without departing from the scope and spirit of the invention.

What is claimed is:

1. A liquid crystal driving device for driving an active matrix type liquid crystal display panel, comprising:

a scan line driving circuit driving a scan line of the liquid crystal display panel;

a signal line driving circuit driving a signal line of the liquid crystal display panel;

a common electrode driving circuit driving a common electrode of the liquid crystal display panel; and an image recognition circuit determining a common electrode voltage value of a voltage applied to the common electrode of the liquid crystal display panel based on input image data, wherein the input image data comprises a plurality of gray scale values corresponding to a plurality of pixels, and wherein the image recognition circuit stores a preset priority of gray scales and a plurality of voltage candidate values preset in accordance with the gray scales, determines a gray scale value having the highest priority out of the plurality of gray scale values based on the preset priority of gray scales, and determined a voltage candidate value corresponding to the gray scale value out of the plurality of gray-scale values as the common electrode voltage value.

2. The liquid crystal driving device according to claim 1, wherein the image recognition circuit determines the common electrode voltage value based on the input image data in one frame period to change a voltage applied to the common electrode in the one frame period.

3. The liquid crystal driving device according to claim 1, wherein the image recognition circuit determines the common electrode voltage value based on the input image data in a period shorter than one frame period to change a voltage applied to the common electrode in the period shorter than the one frame period.

4. The liquid crystal driving device according to claim 1, wherein the image recognition circuit determines the common electrode voltage value based on the input image data in one horizontal scanning period to determine a voltage applied to the common electrode in the one scanning period.

5. The liquid crystal driving device according to claim 1, wherein the gray scales of the image data are prioritized for each of R, G, and B to determine the common electrode voltage value.

6. A liquid crystal driving device for driving an active matrix type liquid crystal display panel, comprising:

a scan line driving circuit driving a scan line of the liquid crystal display panel;

a signal line driving circuit driving a signal line of the liquid crystal display panel;

a common electrode driving circuit driving a common electrode of the liquid crystal display panel; and an image recognition circuit determining a common electrode voltage value of a voltage applied to the common electrode of the liquid crystal display panel based on input image data, wherein the input image data comprises a plurality of gray scale values corresponding to a plurality of pixels, and wherein the image recognition circuit stores a plurality of voltage candidate values preset in accordance with gray scales, and determines a voltage candidate value corresponding to a gray scale value that most frequently appears among the plurality of gray scale values as the common electrode voltage value.

7. A liquid crystal driving device for driving an active matrix type liquid crystal display panel, comprising:

a scan line driving circuit driving a scan line of the liquid crystal display panel;

a signal line driving circuit driving a signal line of the liquid crystal display panel;

a common electrode driving circuit driving a common electrode of the liquid crystal display panel; and an image recognition circuit determining a common electrode voltage value of a voltage applied to the common electrode of the liquid crystal display panel based on input image data, wherein the input image data comprises a plurality of gray scale values corresponding to a plurality of pixels, and wherein the image recognition circuit stores a plurality of voltage candidate values preset in accordance with gray scale profiles of the input image data, and selects a gray scale profile corresponding to a profile of the plurality of gray scale values included in the input image data, and determines a voltage candidate value corresponding to said selected gray scale profile as the common electrode voltage value.

8. The liquid crystal driving device according to claim 1, further comprising a control circuit instructing the scan line driving circuit and the signal line driving circuit about a driving timing, and instructing the common electrode driving circuit about the timing of changing the voltage applied to the common electrode to the common electrode voltage value determined with the image recognition circuit in accordance with the timing of driving at least one of the scan line and the signal line.

9. A liquid crystal display device, comprising:

the liquid crystal driving device according to claim 1; and a liquid crystal display panel drive with the liquid crystal driving device.

* * * * *